US005638627A

United States Patent [19]

Klein et al.

[11] Patent Number: 5,638,627

[45] Date of Patent: Jun. 17, 1997

[54] LOCK FOR FIREARMS WITH TRIGGER BLOCKING FUNCTION

[75] Inventors: Helmut Klein, Velbert; Wolfgang Buss, Solingen, both of Germany

[73] Assignee: Franzen International, Inc., Oakland, N.J.

[21] Appl. No.: 609,480

[22] Filed: Mar. 1, 1996

[30] Foreign Application Priority Data

Mar. 27, 1995 [DE] Germany ..... 195 11 155.9

[51] Int. Cl.[6] ..... F41A 17/54; F41A 17/04

[52] U.S. Cl. ..... 42/70.07; 42/70.06; 42/70.11

[58] Field of Search ..... 42/70.06, 70.07, 42/70.11

[56] References Cited

U.S. PATENT DOCUMENTS

| | | | |
|---|---|---|---|
| 3,392,471 | 7/1968 | Foote | 42/70.07 |
| 3,624,945 | 12/1971 | Foote | 42/70.07 |
| 3,637,180 | 1/1972 | Parry | 248/203 |
| 4,499,681 | 2/1985 | Bako et al. | 42/70.07 |
| 5,261,177 | 11/1993 | Armstrong | 42/70.08 |
| 5,417,000 | 5/1995 | Chen | 42/70.06 |

FOREIGN PATENT DOCUMENTS

| | | | |
|---|---|---|---|
| 1290330 | 9/1972 | United Kingdom | 42/70.07 |

*Primary Examiner*—Stephen M. Johnson
*Attorney, Agent, or Firm*—Shapiro and Shapiro

[57] ABSTRACT

A lock for a firearm that includes two locking elements located on either side of the trigger guard. One of the locking elements contains a plug-in unit and the other of the locking elements contains a receiver in mating contact with the plug-in unit via a meshing toothed arrangement. A handle attached to the plug-in unit rotates 90 degrees to unmate the toothed arrangement. Rotation of the handle by 90 degrees after a combination lock located in the handle is unlocked results unmating of the toothed arrangement.

6 Claims, 9 Drawing Sheets

LOCK FOR FIREARMS WITH TRIGGER BLOCKING FUNCTION

Figure 1:
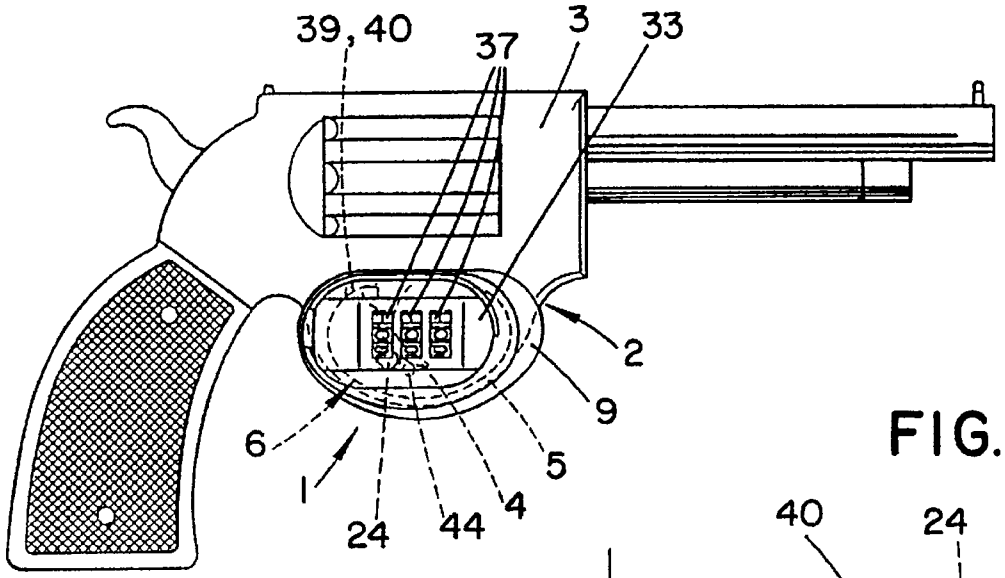
Figure 2:
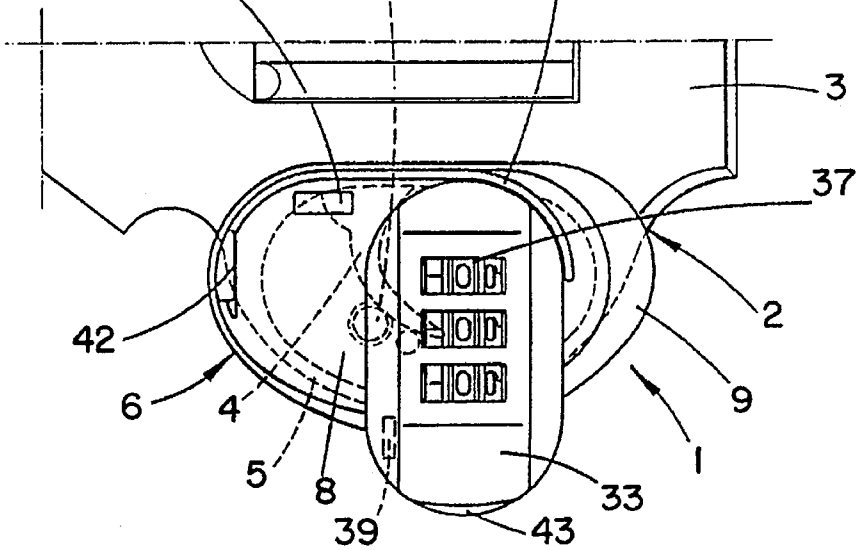
Figure 3:
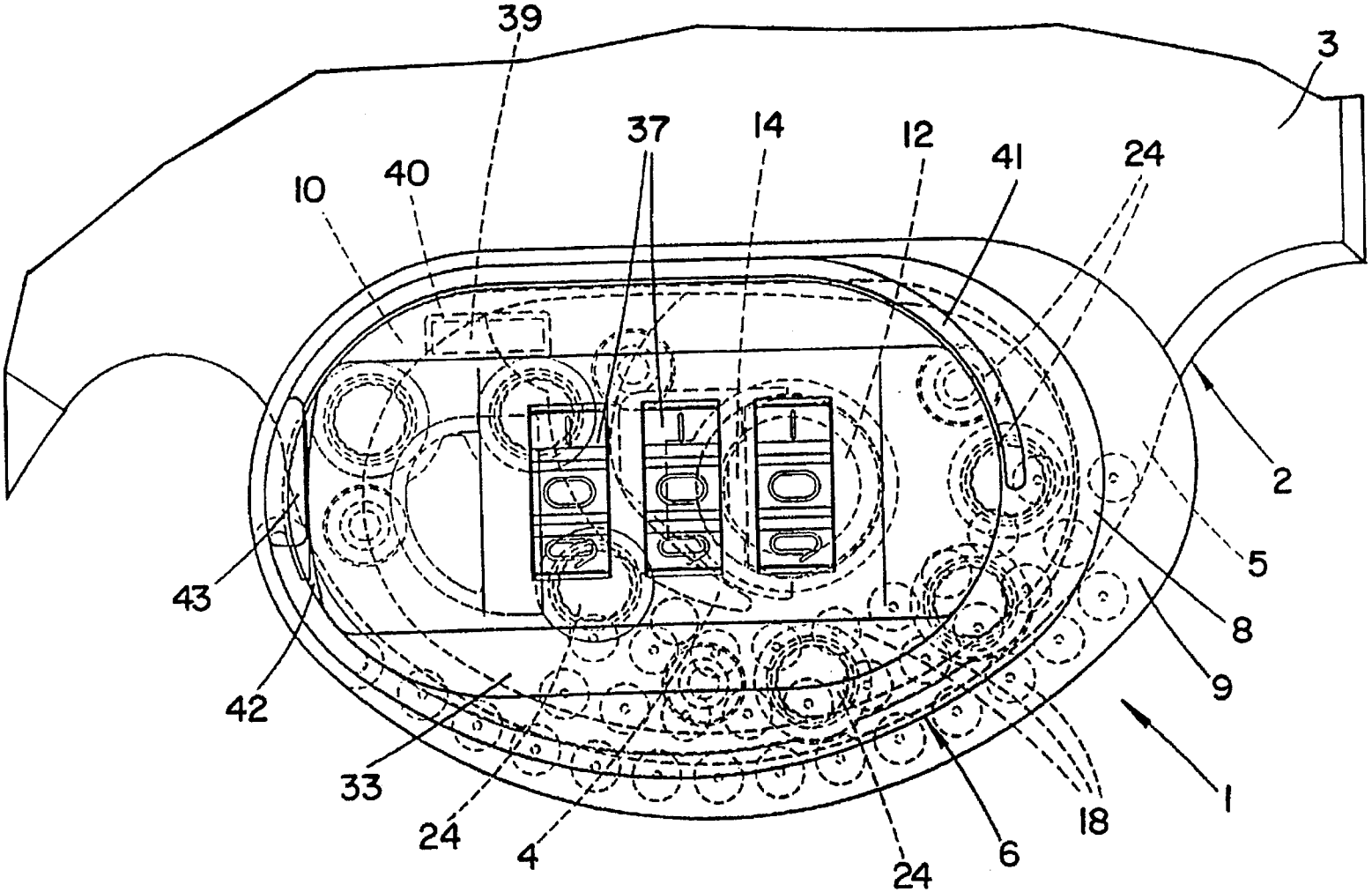
Figure 4:
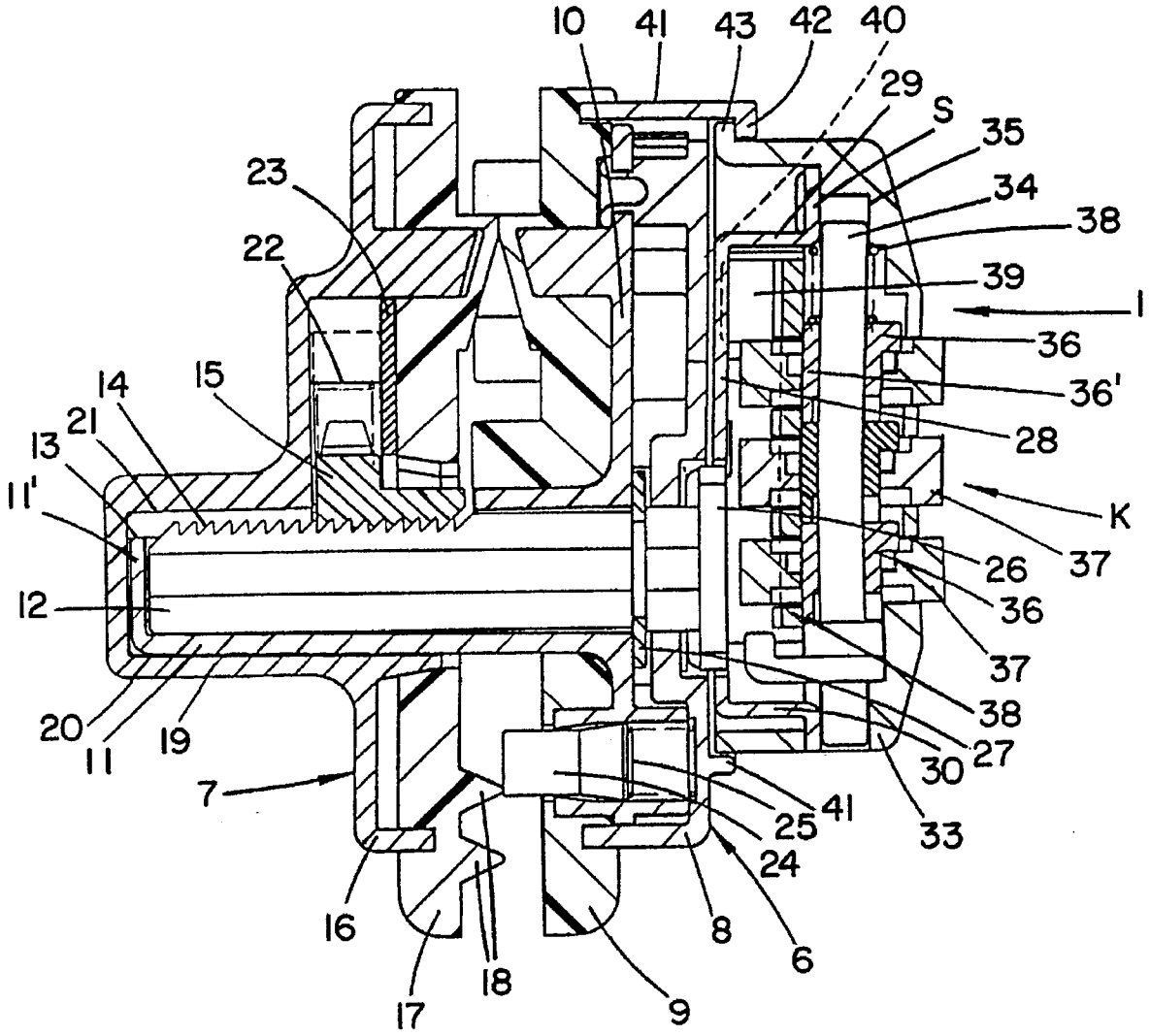
Figure 5:
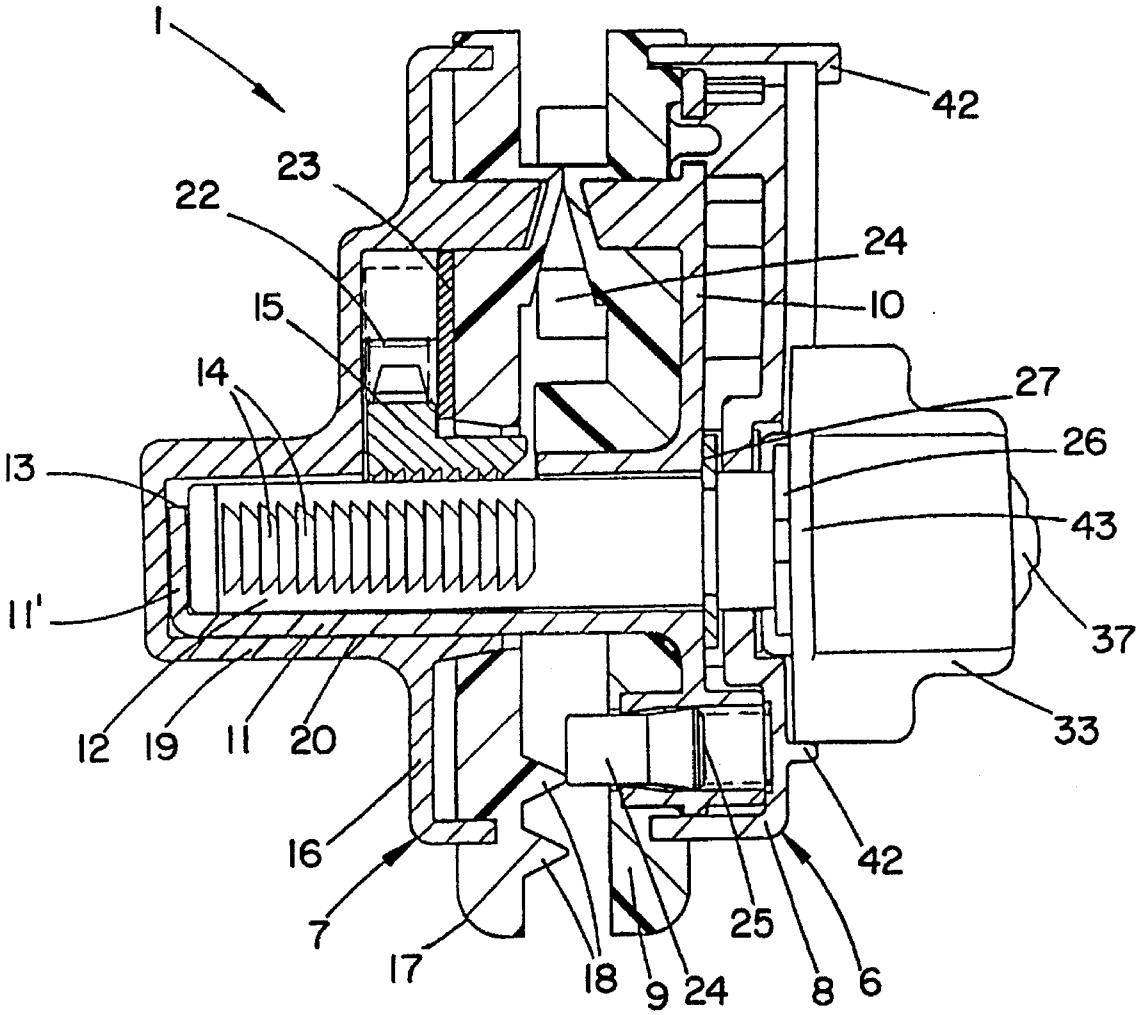
Figure 7:
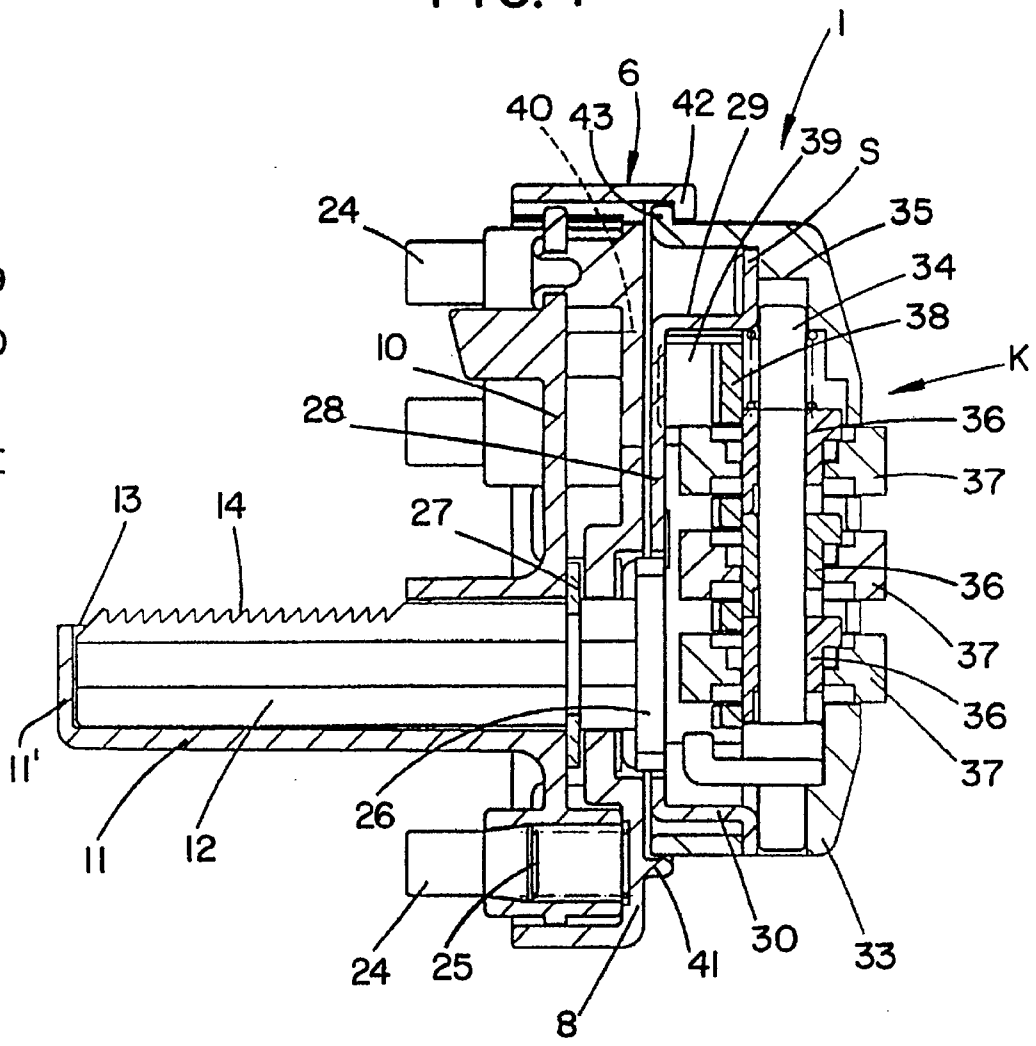
Figure 6:
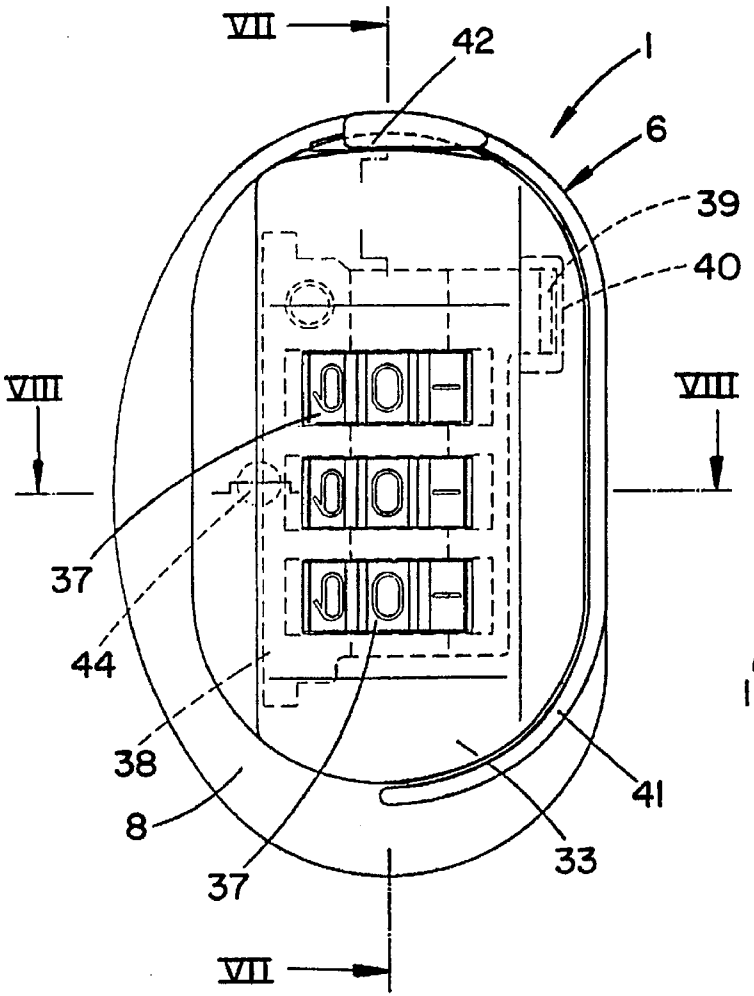
Figure 9:
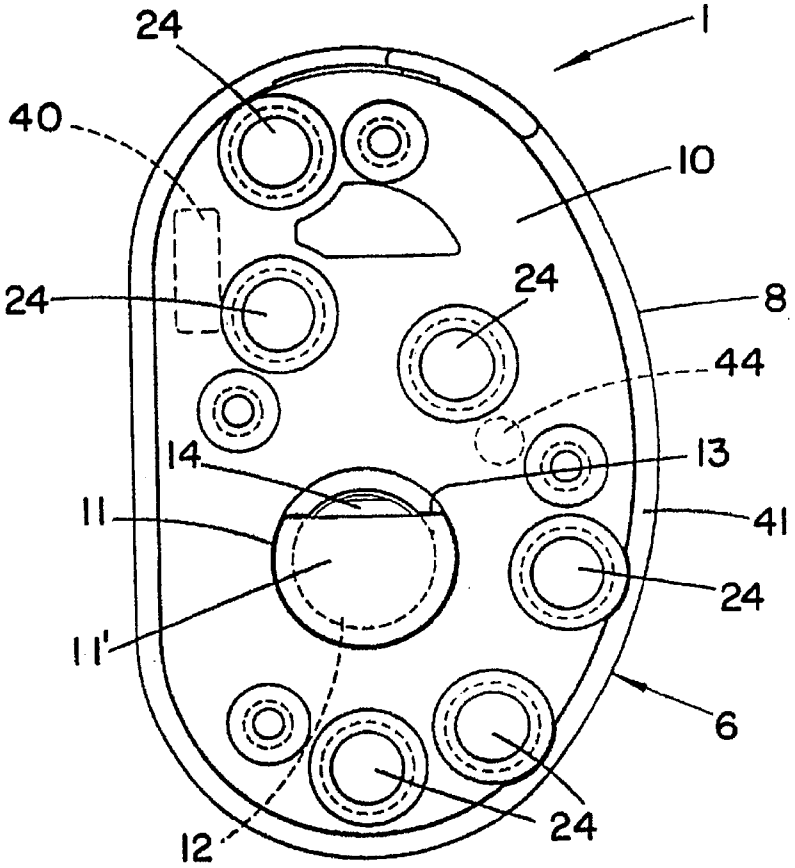
Figure 8:
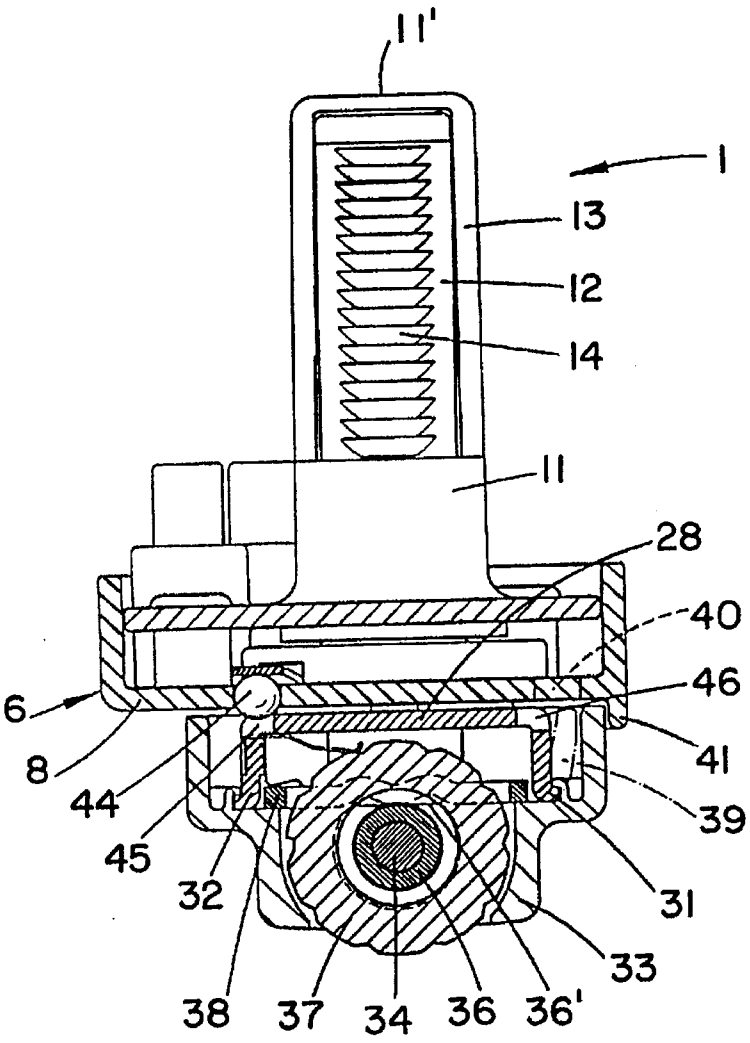

The invention refers to a lock for firearms with trigger blocking function, consisting of two lock elements which enclose the trigger unit on both sides and for which a specific spacing is maintained by means of a plug-in connection due to the meshing of toothed sections, for the purpose of which a plug-in gudgeon, allocated to one of the lock elements, may be inserted into a plug-in aperture located in the other lock element and moved to a lockable position of the meshing toothed sections.

A lock of the type in question is known from the Printed U.S. Pat. No. 3,624,945, with the one lock element being the carrier of a key-actuated locking cylinder. The cylinder core of which is coupled with the plug-in gudgeon, forming a saw toothed section, which in turn cooperates with a correspondingly shaped spring-loaded toothed rack, protruding into the plug-in aperture of the other lock element. Whenever the locking cylinder is in its locking position, the toothed rack and toothed section align so that a latching-type deflection of the toothed rack during the joining of the two lock elements occurs. Whenever the locking cylinder is in its open position, the plug-in gudgeon is rotated accordingly in a way that the toothed rack is lifted via the circular circumference of the plug-in gudgeon, with a meshing of the toothed sections, however, not yet taking place. This meshing does not occur until the cylinder core is rotated back into the locking position of the key, with the toothed section of the plug-in gudgeon meshing with the toothed rack. Due to this the opening and locking of the lock for firearms always requires the respective key to be used. If the meshing of the toothed section with the toothed rack is brought about under high tension, it is furthermore required that relatively high forces will have to be introduced by means of the key in order to rotate the plug-in gudgeon away from the meshing position.

The subject matter of the invention is based on the requirement to design a lock for firearms of the type in question in such a way that the handling is simplified while at the same time maintaining the proven design features.

This requirement is met for a lock for firearms of the type in question since the plug-in gudgeon is connected to a handle which may be rotated relative to the one lock element and which is the carrier of a combination lock.

As a consequence of a design of the above type, a lock for firearms of the type in question with trigger blocking function that offers a simplified handling is mentioned. In order to achieve a lockable position where the toothed sections mesh, no specific locking cylinder and, as a result, also no key are required since the handle itself is the carrier of a combination lock. This lock may e.g. be a combination lock the number wheels of which are arranged one after the other on one and the same axis, displaying the FIGS. 0 through 9. After the specified key code has been set, the plug-in gudgeon may be rotated by turning the handle relative to the one lock element, disengaging the meshing of the toothed sections, the position thus obtained allowing for the separation of the two lock elements while at the same time releasing the trigger of the firearm previously secured by the lock. The longitudinal dimension of the handle may almost be as large as that of the one lock element, allowing for a large lever to be effective, in particular if the handle is positioned eccentrically, which in turn makes the disengagement of the meshing toothed sections easy, even if the lock elements are engaged tightly, utilizing protective plates made of a flexible material. One protective plate will usually be allocated to each lock element. This plate may either be manufactured of rubber or an appropriate plastic material. Once the two lock elements have been engaged it is ensured that at least one component of the lock is in the way of travel of the trigger, reliably preventing its displacement and thus the firing of a bullet.

An advantageous further development of the lock is due to the fact that the turning of the handle, which is connected to the plug-in gudgeon in a way to where they may not be turned independently, may be blocked. If the key code is set properly any turning of the handle will always result in a corresponding movement of the the plug-in gudgeon. Once a meshing of the toothed sections has occured the handle may be blocked simply by changing the key code. This in turn prevents the plug-in gudgeon from being rotated relative to the one lock element. The securing of the trigger achieved by the lock for firearms may thus not be neutralized.

An advantageous feature of the invention is characterized by an extension of a locking link which engages into a recess of the one lock element whenever the combination lock is actuated. Whenever the specified key code is set at the combination lock, the locking link may be dislocated to where its extension retracts from the recess of the one lock element. This in turn releases the handle to where it may be turned while simultaneously moving the plug-in gudgeon. If the number wheels are turned, causing the key code to be changed, then the extension of the locking link will be dislocated, thus engaging into the recess whenever the meshing position of the toothed section is acheived.

In accordance with the invention it is advantageous that the locking link is designed as a rocker positioned in the same direction as the handle. The latter may, as is quite common for many combination locks, cooperate with locking sleeves allocated to the individual number wheels. These locking sleeves feature flat sections. Whenever the flat sections of the locking sleeves align due to the corresponding turning of the number wheels, which corresponds to the proper key code, the rocker of the locking link may be dislocated in such a way that the extension retracts from the recess of the one lock element. The handle is now released to where it may be turned.

The safety provided by the lock for firearms is increased due to the fact that the locking link may only be dislocated whenever the combination lock is in its locked position. If the handle is turned from the meshing position of the toothed sections into their released position, then the extension is positioned above the front surface of the one lock element facing it. The number wheels may now not be turned since the rocker is supported by the front surface via the extension. A dislocation of the number wheels thus always requires the handle to be turned back to the meshing position of the toothed sections.

From a handling point of view it is favorable to provide for a detent of the handle in its two end positions of rotation. This detent is distinctly noticeable and, on the one hand, indicates that the toothed sections mesh and, on the other, that the toothed sections no longer mesh.

It is furthermore an advantageous feature of the invention that the handle is equipped with a lug that faces outwards at its longer lever arm including the extension, which in turn moves behind a hook-shaped protrusion of the lock element that accommodates it whenever the handle is in its lockable end position. Due to this it is not possible to disengage the handle in the area of this particular lever arm by means of the blade of a screwdriver, which in turn ensures that the extension of the locking link remains within the recess of the one lock element as required.

Figure 10:
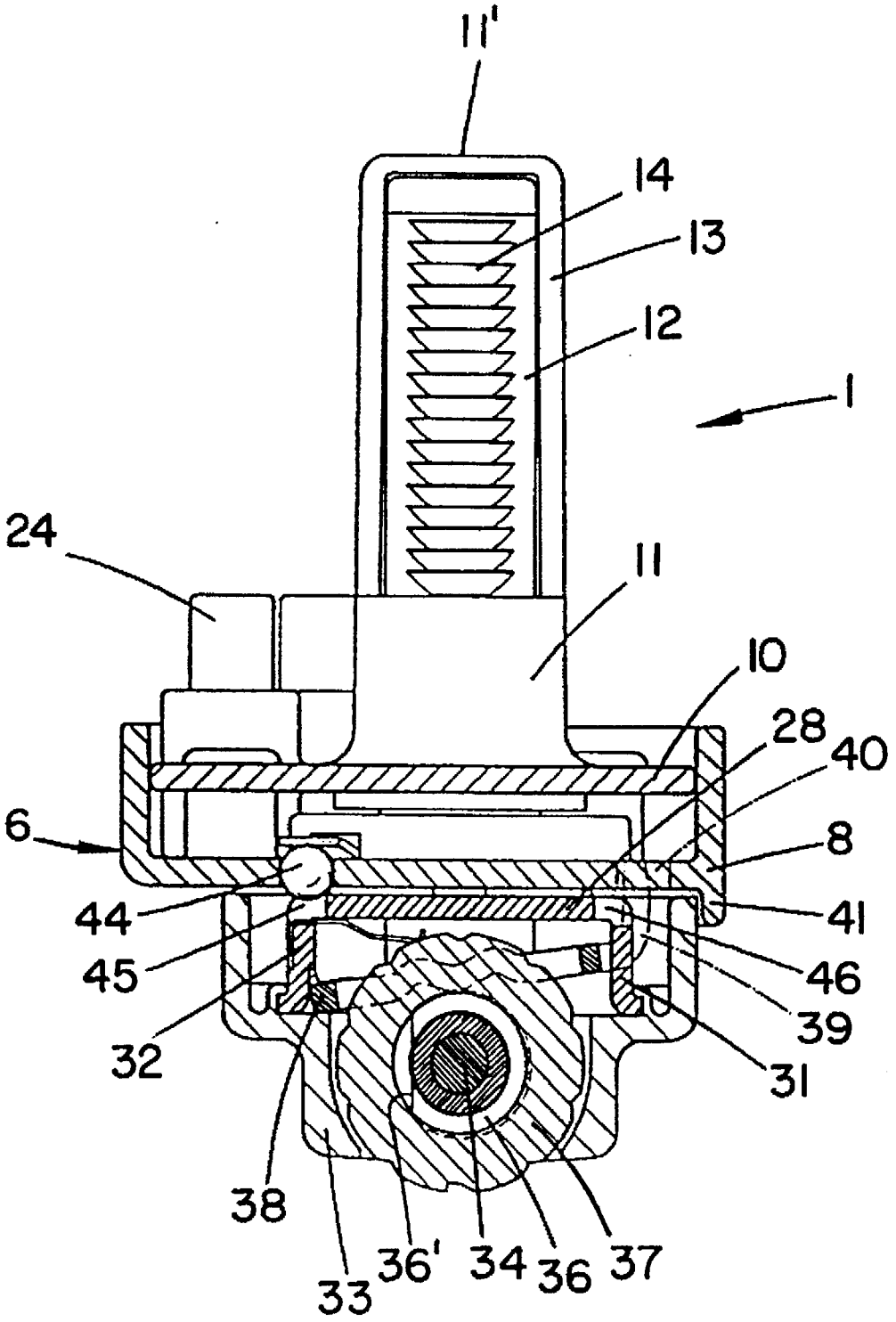
Figure 12:
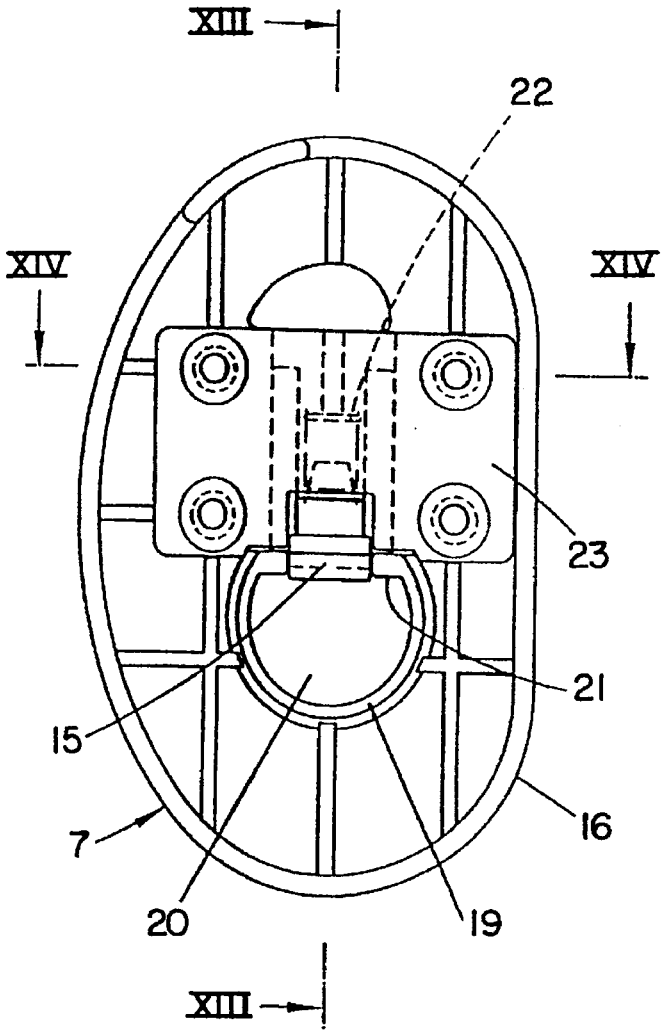
Figure 13:
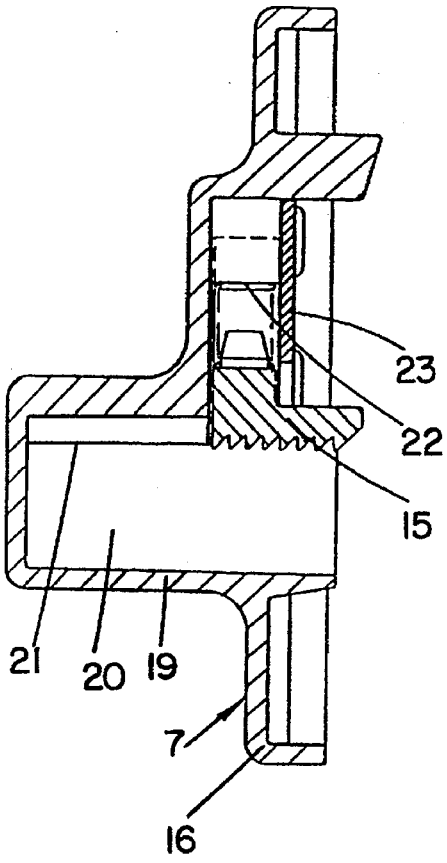
Figure 14:
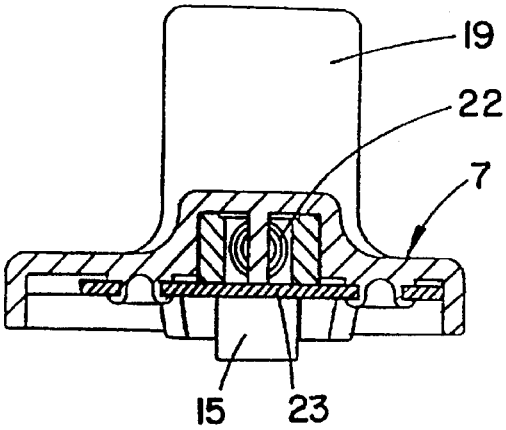

In the following one example for the execution of the invention is explained on the basis of the drawings included. The example shows FIG. 1 a view of a pistol with a lock for firearms attached to its trigger unit, with the toothed sections of the lock elements meshing, FIG. 2 a detailed view in the area of the trigger unit incl. the lock for firearms, with the actuation handle turned from the meshing position of the toothed sections into the released position, FIG. 3 a top view as an enlarged representation of the lock for firearms attached to the trigger unit, referring to the meshing position of the toothed sections of the lock elements, FIG. 4 a longitudinal section of the lock for firearms with the lock elements in their meshing position, with the correct key code set and the handle released for turning, FIG. 5 a longitudinal section in accordance with FIG. 4, with—deviating from it—the handle rotated by 90° into the released position, FIG. 6 a front view of the one lock element, illustrating the locking link, designed as a rocker, FIG. 7 a section through line VII—VII in FIG. 6, FIG. 8 a section through line VIII—VIII in FIG. 6, FIG. 9 a rear view of the one lock element with the protective plate omitted, FIG. 10 a representation in accordance with FIG. 8, with—contrary to it—the key code deviating, the locking link swivelled and the handle locked, FIG. 11 a top view of the lock element positioned on the side of a trigger bow, FIG. 12 a rear view of the other lock element with the protective plate omitted, FIG. 13 a section through line XIII—XIII and FIG. 14 a section through line XIV—XIV.

According to the example of execution represented, a lock for firearms 1 in accordance with the invention is attached to the trigger unit 2 of a pistol 3. The trigger unit 2 forms a trigger bow 5 which encloses a trigger 4. Due to the above it would also be possible to attach the lock for firearms to the trigger unit of a rifle.

Individually the lock for firearms 1 is composed of two lock elements 6 and 7, enclosing the trigger unit 2, which are positioned on both sides of the trigger bow 5, covering the opening formed by it and thus making any access to the trigger 4 impossible.

The one lock element 6 features a cover 8 with a protective plate 9, manufactured of flexible plastic material, pushed over the edge of the cover. A base plate 10 stretches between the bottom of the cover 8 and the protective plate 9 which in turn extends, forming a bearing bush 11 to accommodate a plug-in gudgeon 12. The latter is positioned eccentrically in comparison to the longitudinal axis of the cover 8, the horizontal projection of which is roughly oval. The bearing bush 11 is opened by a secant-shaped cut-away sector 13. The opening points towards the longer side of the oval cover. On the front end, the bearing bush 11 is closed off by a bush closure 11'.

The cross-section of the plug-in gudgeon 12 is basically circular. Deviating from this circular shape, the plug-in gudgeon forms a flat segment which, however, protrudes beyond the receptacle 13. The plug-in gudgeon 12 features a saw-toothed shaped section 14 on this flat segment. This toothed section 14 cooperates with a correspondingly shaped toothed rack 15, which forms saw-shaped teeth and which is accommodated by the other lock element 7. This element forms a counter cover 16 the shape of which is identical with that of the cover 8. A counter plate 17 encloses the edge of this counter cover 16, the curved longitudinal edge of which features conical raised sections 18, which, as being state-of-the-art of technology, are not explained separately. The bottom section of the counter cover 16 extends into a plug-in bushing 19 to accommodate the bearing bush 11 and the plug-in gudgeon 12. The plug-in opening 20 of this plug-in bushing 19, due to its secant-shaped wall section 21, deviates from the circular shape and thus corresponds to the cross sectional profile of the bearing bush 11 in the area of the receptacle 13. A toothed rack 15 is parallel to the wall section. A pressure spring 22 exerts pressure on the toothed rack 15 in the meshing direction towards the toothed section 14 of the plug-in gudgeon 12, cf. FIG. 4. A cover plate 23, connected to the counter cover 16, is used to secure the position of the toothed rack 15 as well as of the pressure spring 22.

The base plate 10 supports the protective plate 9 by means of locking pins 24. In outward direction these may be shifted to a limited extent and they are subject to a pressure exterted by the pressure springs 25 in outward direction. With the example of execution given, six of these locking pins 24 are distributed and attached to the base plate 10. At least one of these locking pins 24 extends into the direction of displacement of the trigger 4 when the lock for firearms 1 is attached.

The end of the plug-in gudgeon 12 opposite to the toothed section 14 penetrates the cover 8 and is equipped with a coupling protrusion 26 there. This protrusion is partially responsible for ensuring that the plug-in gudgeon may not be displaced axially. A circlip 27 is furthermore provided for this purpose. It engages in a circular groove of the plug-in gudgeon 12 and extends between the base plate 10 and the bottom section of the cover 8. The coupling protrusion 26 positively engages in the bottom section 28 of the lock housing S. The latter is roughly box shaped and forms the end walls 29, 30. The box furthermore features the two longitudinal walls 31, 32. The lock housing S extends within a toggle-shaped handle 33. The latter and the lock housing S are connected to one another by rivets not illustrated in detail. A rotary shifting of the handle 33 is thus transmitted onto the plug-in gudgeon 12 via the lock housing.

In the upper section the handle 33 accommodates an axis 34 supported by the box end walls 29, 30. The supporting cavity 35 in the handle 33 is open towards one side. The end of axis 34 extends to this opening. Three locking bushings 36 are supported one behind the other on this axis 34, featuring a flat section 36'. The flat section 36' could also be designed as an abtuse-angled taper. This is a known fact and therefore no specific explanation is given. The locking bushings 36 mesh with the number wheels 37 in a known manner. By turning these wheels, the locking bushings are entrained. A pressure spring 38, located on the axis 34, exerts pressure on the locking bushings 36 in the meshing direction towards the number wheels 37.

A locking link 38 cooperates with the locking bushings 36. The link's cross section is designed angularly and as a rocker. The longer leg of the angle is spring-loaded in the direction of the locking bushing 36 by a spring which is not illustrated in the drawing, while the other leg of the angle forms an extension 39 which, provided that the key code is set properly, extends towards the front end of the cover 8. When in the meshing position, the extension 39 is opposite of a recess 40 of the cover 8 of the one lock element 6, cf. in particular FIG. 8. The extension 39 is located in the longer lever arm of the handle 33, the reason why the recess 40 of the cover 8 is located at a greater distance from the axis of rotation of the plug-in gudgeon 12. Furthermore the recess 40 is located close to the edge 41 of the cover 8, with the edge 41 extending approximately along half of the circumference of the cover 8. The length of the edge was chosen in a way to allow for the handle 33 to be swivelled by 90°. The one end of the edge 41 forms a hook-shaped protrusion 42 behind which a lug 43 of the handle 33 facing in outward direction extends in the meshing position, cf. in particular FIG. 4. Due to this, whenever the meshing position is achieved, the handle 33 may not be lifted with the blade of a screwdriver in order to disengage the extension 39 from the recess 40.

The cover 8 carries a detent ball 44. The latter cooperates with the detent recesses 45, 46 of the lock housing S. In the meshing position the detent ball 44 protrudes into the detent recess 45. If the handle 33 is rotated by 90° the other detent recess 46 will cooperate with the detent ball 44, with both detent positions being distinctly noticeable.

Figure 11:
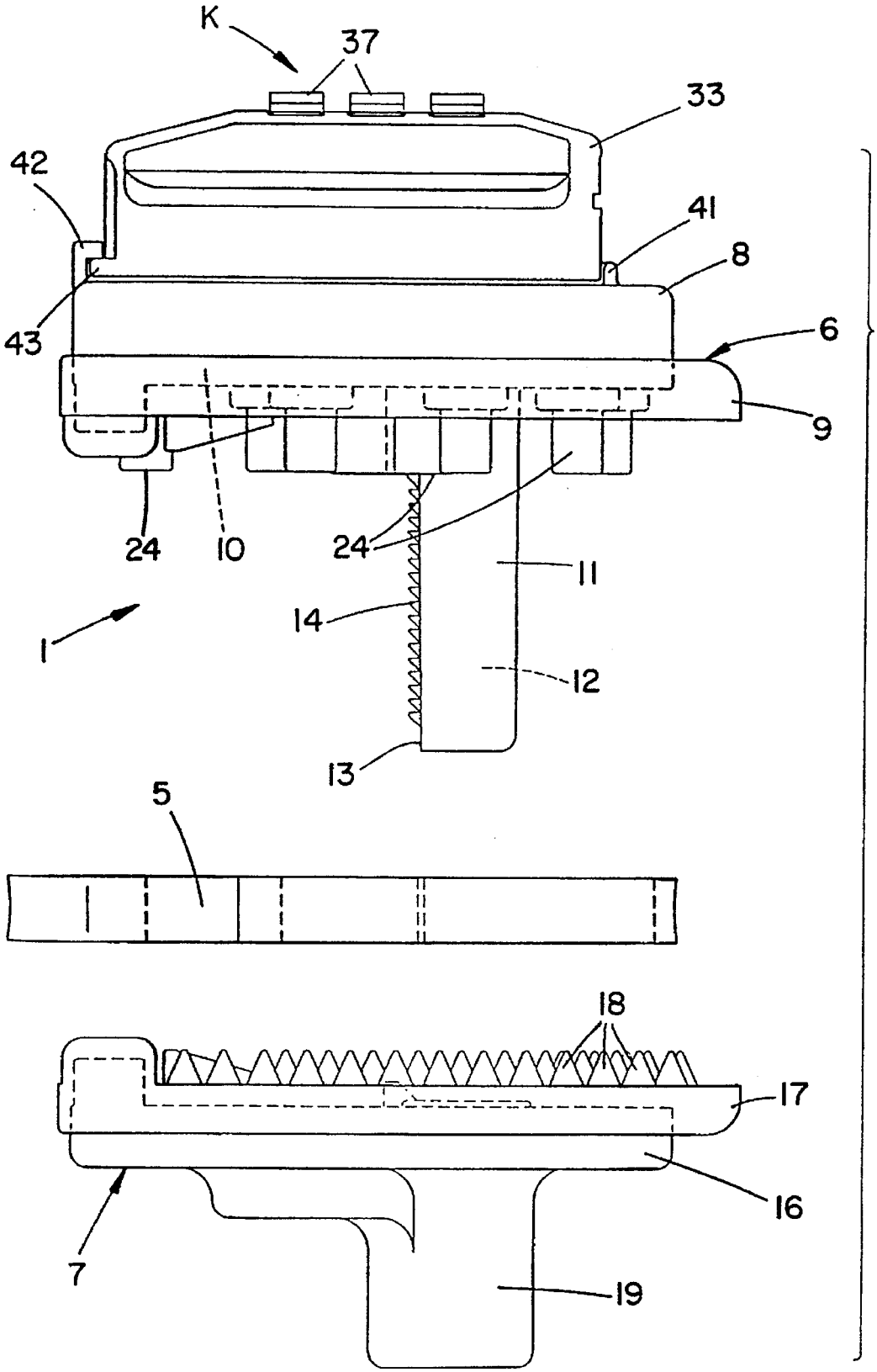

The following action takes place:

The lock elements 6, 7 are preferrably attached to the trigger unit 2 in such a way that the handle 33 is located in longitudinal direction of the cover 8 resp. of the one lock element 6. In the following the lock elements 6, 7, as illustrated in FIG. 11, are plugged together from both sides of the trigger bow 5, with the bearing bush 11 of the one lock element 6 inserted into the plug-in opening 20 of the other lock element 7. The toothed section 14 of the plug-in gudgeon 12 contacts the teeth of the toothed rack 15, the latter deflecting in a latching-type motion. The lock elements 6, 7 are now pressed against one another. The protective plate 9 and the counter plate 17 move against the trigger bow 5. Once the two lock elements have been joined, they will cover the opening of the trigger bow and thus also the trigger 4. At least one locking pin 24 will then be in the way of travel of the trigger 4, reliably preventing any manipulations of the trigger. If the key code is still set properly, the rocker-type locking link 38 may be swivelled by turning at least one of the number wheels 37, with the extension 39 moving into the recess 40 of the lock element 6 resp. of the cover 8 which is aligned with it. This in turn locks the handle 33 to the lock element 6 to where it may not be turned independently, reliably preventing any rotation of the plug-in gudgeon 12. The meshing of the plug-in gudgeon 12 and the toothed rack 15 may thus not be neutralized.

The meshing of the plug-in gudgeon 12 and the toothed rack 15 may only be neutralized if the plug-in gudgeon 12 is rotated, namely by means of handle 33. For this purpose it is required to set the specified key code of the combination lock K by means of the number wheels 37. This in turn causes the locking bushings 36 to be turned in a way that the flat sections 36' align and allow for a swivelling of the spring-loaded locking link 38. The extension 39 simultaneously retracts from the recess 40 of the one lock element 6. The handle 33 may now be turned by 90° to the position illustrated in FIG. 2 and 5, with the meshing of the plug-in gudgeon 12 and the toothed rack 15 being neutralized. The two lock elements 6, 7 may now be pulled apart, thus releasing the trigger unit.

The position of the handle 33, turned by 90°, now reaches a detent position. In this particular position the extension is above the front of the cover 8 facing it. The spacing between the extension 39 and the front of the cover 8 is so that the number wheels 37 may not be turned since the front end of the extension 39 would then contact the cover 8. A turning of the number wheels 37 will not be possible until the handle 33 has been turned back by 90° to where the extension 39 and the recess 40 again align.

Furthermore provisions have been made to ensure that a resetting of the key code will only be possible if the original key code has been set properly, for the purpose of which the axis 34 is shifted against the spring load and over the supporting cavity 35 of the handle 33, which is open on one side, neutralizing the meshing of the locking bushings 36 and the number wheels 37. This, however, is the known state-of-the-art of technology and due to this no further explanation is given.

In principle it may be stated that even if the two lock elements 6, 7 are joined very tightly, a large lever arm exists due to the handle 33 which in turn ensures that the lock for firearms may always be opened easily. Furthermore no separate key is required for this purpose. The only thing to be done is to set the specified key code by means of the number wheels 37.

We claim:

1. A lock for blocking the operation of a trigger of a trigger unit of a firearm, comprising two lock elements engageable to enclose the trigger unit from opposite sides thereof and to maintain engagement by meshing of cooperable toothed sections of the respective lock elements, one of the toothed sections being associated with a plug-in unit and the other toothed section being associated with a receiver for the plug-in unit, wherein the plug-in unit is connected to a handle manually turnable between a first position in which the toothed sections are meshed, and a second position in which the toothed sections are not meshed so that the plug-in unit may be withdrawn from the receiver and the lock elements may be separated from the trigger unit, and wherein the handle comprises a combination lock configured to be manually grasped to turn the handle, and the combination lock and said one lock element have cooperable members which prevent turning of the handle from said first position to said second position until the combination lock is unlocked.

2. A lock in accordance with claim 1, wherein the handle extends eccentrically from the plug-in unit.

3. A lock in accordance with claim 1 or 2, wherein the combination lock has combination dials and a locking link movable between locking and unlocking positions in accordance with positions of the combination dials, one of said cooperable members being moved away from the other of said cooperable members when the handle is in said first position and said locking link is moved from its locking position to its unlocking position.

4. A lock in accordance with claim 3, wherein the locking link is pivotally movable and supports one of said cooperable members, one of said cooperable members having a protrusion and the other having a recess.

5. A lock in accordance with claim 4, wherein said cooperable members are covered by a shield when said handle is in said one position.

6. A lock in accordance with claim 1 or 2, wherein the handle and said one lock element have cooperable detent elements for releasably holding the handle in said first and second positions alternatively.

* * * * *